US006417807B1

(12) United States Patent
Hsu et al.

(10) Patent No.: US 6,417,807 B1
(45) Date of Patent: Jul. 9, 2002

(54) OPTICALLY CONTROLLED RF MEMS SWITCH ARRAY FOR RECONFIGURABLE BROADBAND REFLECTIVE ANTENNAS

(75) Inventors: Hui-Pin Hsu, Northridge; Tsung-Yuan Hsu, Westlake Village, both of CA (US)

(73) Assignee: HRL Laboratories, LLC, Malibu, CA (US)

( * ) Notice: Subject to any disclaimer, the term of this patent is extended or adjusted under 35 U.S.C. 154(b) by 0 days.

(21) Appl. No.: 09/845,033

(22) Filed: Apr. 27, 2001

(51) Int. Cl.[7] ..... H01Q 1/36; H01Q 3/24

(52) U.S. Cl. ..... 343/700 MS; 343/876; 343/781 CA; 343/795; 333/262

(58) Field of Search ..... 343/781 CA, 793, 343/795, 770, 876, 853; 333/107, 262; 200/181; 250/214.1, 214 LS

(56) References Cited

U.S. PATENT DOCUMENTS

| | | | | | |
|---|---|---|---|---|---|
| 5,121,089 | A | | 6/1992 | Larson | 333/107 |
| 5,248,931 | A | | 9/1993 | Flesner et al. | 322/2 R |
| 5,293,172 | A | * | 3/1994 | Lamberty et al. | 343/701 |
| 5,511,238 | A | * | 4/1996 | Bayraktaroglu | 331/107 DP |
| 5,541,614 | A | | 7/1996 | Lam et al. | 343/792.5 |
| 5,578,976 | A | | 11/1996 | Yao | 333/262 |
| 5,757,319 | A | | 5/1998 | Loo et al. | 342/375 |
| 6,046,659 | A | | 4/2000 | Loo et al. | 333/262 |
| 6,069,587 | A | | 5/2000 | Lynch et al. | 343/700 MS |
| 6,198,438 | B1 | | 3/2001 | Herd et al. | 343/700 MS |
| 6,307,519 | B1 | * | 10/2001 | Livingston et al. | 343/746 |
| 6,310,339 | B1 | * | 10/2001 | Hsu et al. | 200/181 |

FOREIGN PATENT DOCUMENTS

| | | |
|---|---|---|
| WO | WO 99/50929 | 10/1999 |

OTHER PUBLICATIONS

Freeman, J.L., et al., "Optoelectronically Reconfigurable Monopole Antenna," *Electronics Letters*, vol. 28, No. 16, pp. 1502–1503 (Jul. 30, 1992).

Sun, C.K., et al., "Photovoltaic–FET For Optoelectronic RF/μwave Switching," *IEEE Transactions on Microwave Theory and Techniques*, vol. 44, No. 10, pp. 1747–1750 (Oct. 1996).

Huang, J., "Analysis of a Microstrip Reflectarray Antenna for Microspacecraft Applications," *TDA Progress Report 42–120*, pp. 153–173 (Feb. 15, 1995).

* cited by examiner

*Primary Examiner*—Tan Ho
(74) *Attorney, Agent, or Firm*—Ladas & Parry

(57) ABSTRACT

A method and apparatus for reconfiguring an antenna array by optical control of MEMS switches. A light source is provided to direct light to individual optically sensitive elements which control delivery of actuating bias voltage to the MEMS switches. The light source is preferably separated from the antenna array by a structure which conducts the controlling illumination but provides a high impedance electromagnetically reflective surface which reflects electromagnetic radiation over the antenna operating frequency range with small phase shift, and which is disposed very close to the antenna array. Optically sensitive elements preferably include photoresistive elements, which are best formed in the substrate upon which the MEM switches are formed, and may include photovoltaic elements.

49 Claims, 6 Drawing Sheets

OPTICALLY CONTROLLED RF MEMS SWITCH ARRAY FOR RECONFIGURABLE BROADBAND REFLECTIVE ANTENNAS

CROSS REFERENCE TO RELATED APPLICATIONS

The present invention is related to the following commonly assigned and co-pending U.S. application, "Optically Controlled MEM Switches," filed Oct. 28, 1999, invented by T. Y. Hsu, R. Loo, G. Tangonan, and J. F. Lam, and having U.S. Ser. No. 09/429,234, which is hereby incorporated herein by reference.

FIELD OF THE INVENTION

The present invention pertains to remotely reconfigurable antennas, and particularly to reconfiguring antennas by optical control of mechanical switches.

BACKGROUND OF THE INVENTION

Reconfigurable antenna systems have applications in satellite and airborne communication node (ACN) systems where wide bandwidth is important and where the antenna aperture must be continually reconfigured for various functions. These antenna systems may comprise an array of individually reconfigurable antenna elements. Each antenna element may be individually reconfigurable to modify its resonant frequency, such as by varying the effective length of dipole elements. Varying the resonant frequency of individual elements may enable an antenna to operate at a variety of frequencies, and may also enable control of its directionality.

One means of varying the resonant length of a dipole antenna is to segment the antenna lengthwise on either side of its feed point. The resonant length of the antenna may then be varied by connecting or disconnecting successive pairs of adjacent dipole segments. Connection of a pair of adjacent dipole segments may be effected by coupling each segment to a switch. The adjacent segments are then joined by closing the switch.

Previous designs for reconfigurable antennas have been proposed which incorporate photoconductive switches as an integral part of an antenna element in an antenna array. See "Optoelectronically Reconfigurable Monopole Antenna," J. L. Freeman, B. J. Lamberty, and G. S. Andrews, *Electronics Letters,* Vol. 28, No. 16, Jul. 30, 1992, pp. 1502–1503. Also, the possible use of photovoltaic activated switches in reconfigurable antennas has been explored. See C. K. Sun, R. Nguyen, C. T. Chang, and D. J. Albares, "Photovoltaic-FET For Optoelectronic RF/Microwave Switching," *IEEE Trans. On Microwave Theory Tech.,* Vol. 44, No. 10, October 1996, pp. 1747–1750. One problem with these designs, however, is that the performance of ultra-broadband systems (i.e., systems having an operating frequency range of approximately 0–40 GHz) utilizing these types of switches suffer in terms of insertion loss and electrical isolation.

RF MEMS (micro-electromechanical) switches have been proven to operate over the 0–40 GHz frequency range. Representative examples of this type of switch are disclosed in Yao, U.S. Pat. No. 5,578,976; Larson, U.S. Pat. No. 5,121,089; and Loo et al., U.S. Pat. No. 6,046,659. Previous designs for reconfigurable antennas using RF MEMS switches incorporated metal feed structures to apply an actuation voltage from the edge of a substrate to the RF MEMS switch bias pads. A problem with the use of metal feed structures to apply an actuation voltage to the switches is that, in an antenna array, the number of switches can grow to thousands, requiring a complex network of bias lines routed all around the switches. These bias lines can couple to the antenna radiation field and degrade the radiation pattern of the antenna array. Even when the bias lines are hidden behind a metallic ground plane, radiation pattern and bandwidth degradation can occur unless the feed lines and substrate feedthrough via conductors are very carefully designed because each element in the antenna array may accommodate tens of switches. This problem is magnified enormously as the number of reconfigurable elements increases.

A conductive ground plane generally provides a phase shift of 180° upon reflection of electromagnetic waves. In practice, the conductive ground plane should be separated from the antenna elements by at least a quarter wavelength, to avoid destructive interference at the antenna elements between electromagnetic waves received directly at the antenna elements and waves received via reflection from the ground plane. Hence, if the switches are disposed above a conductive ground plane, the bias lines for the switches will extend at least one quarter wavelength above the ground plane. Bias lines of this length above the ground plane may provide the radiation pattern and bandwidth degradation described above.

Thus, there exists a need for a means to control selectable RF MEMS switches in an array to control antenna elements, while reducing interference from control lines.

SUMMARY OF THE INVENTION

The present invention solves the above-noted problem by providing a mechanism for optical control of an array of MEM switches which in turn modify antenna elements.

MEM switches are mounted on an antenna substrate so as to provide selectable connections between adjacent elements of an antenna structure. The switches are optically controlled, preferably by means of an active LED matrix or an LCD matrix. Control is preferably provided through a structure adjacent to the antenna array, which shields the optical control circuitry and preferably provides a reflective surface to aid the antenna. The low-power, voltage-controlled MEM switches are provided with an actuating bias voltage, either by means of direct connections, through the reflective surface if used, or by means of an illuminated series of photovoltaic (PV) cells. Optical control of each MEM switch is preferably provided by a photoresistive element that shunts the bias source to deactuate the switch.

The preferred reflective surface presents a high impedance to electromagnetic waves in the antenna operating frequency range, and accordingly reflects the waves with little or no phase shift (less than 90 degrees, and preferably near 0). This reduces array-to-reflector spacing distance and alleviates bandwidth constraints, which are imposed by that spacing. The preferred embodiment of the present invention includes a high impedance reflective surface fabricated on a multilayer printed circuit board as a matrix of conductive pads, each having controlled capacitance to adjacent pads and having a via with controlled inductance connecting from its center to a common plane on the opposite side of the board. The controlled inductance vias, or other vias through the reflective surface, may provide for light transmission from the active matrix optical panel to the photoelectric elements controlling the MEM switches, and may also conduct bias voltage for the switches. The antenna array elements are preferably disposed on a substrate positioned above the front side of the high-impedance surface of the circuit board and much less than ¼ wavelength from the front side of the high-impedance reflective surface.

DETAILED DESCRIPTION

A ground plane comprising a conductive reflective surface lying below antenna elements is a common feature of most radio frequency antennas. The ground plane may be used to perform the useful function of directing most of the radiation into one hemisphere in which the antenna elements are located. As discussed above, the ground plane may also be used to electrically isolate antenna control functions from the antenna elements themselves, so as not to degrade antenna performance. A reflective surface for the present invention may be conductive, but that introduces restrictive wavelength-dependent constraints on the spacing between the reflective surface and the antenna array. Instead of a conductive reflective surface, it is preferable to use a non-conductive reflective surface.

Reflective surfaces are known in the art which reflect electromagnetic waves with a phase shift near zero, and are relevant to the preferred embodiment of the present invention. In particular, such "high impedance" surfaces may be formed on a printed circuit board, as described in publication WO 9950929 of international patent application PCT/US99/06884 by Yablonovitch and Sievenpiper. Yablonovitch and Sievenpiper disclose an array of separate conducting elements, each element comprising a resonant circuit that is capacitively coupled to adjacent elements and inductively coupled in common, and each element having an exposed surface. The conducting elements collectively act as a reflective surface that allows antenna elements to be disposed within much less than one quarter wavelength of the reflective surface. The reduced distance between the reflective surface and the antenna elements reduces the lengths of any connections that must be made to the antenna elements or switch elements used to connect or reconfigure the antenna elements.

For high frequencies, the wavelength of the electromagnetic waves is short; for example, at 30 GHz, the wavelength is about 1 cm. As discussed above, a conductive reflective surface for antenna elements operating at that frequency should be disposed one quarter wavelength below the elements, or 2.5 mm. This spacing increases the overall height of the resulting antenna array and also increases the likelihood of antenna control lines interfering with the performance of the antenna, since these lines will have lengths on the order of a quarter wavelength. With a high impedance surface, at 30 GHz, the spacing from the antenna elements to the high-impedance reflective surface is preferably substantially less than 2.5 mm, and is ideally not more than 250 $\mu$m. Essentially, the antenna elements are right on top of the reflective surface, so the lengths of any control lines above the surface are nearly negligible.

Figure 1:
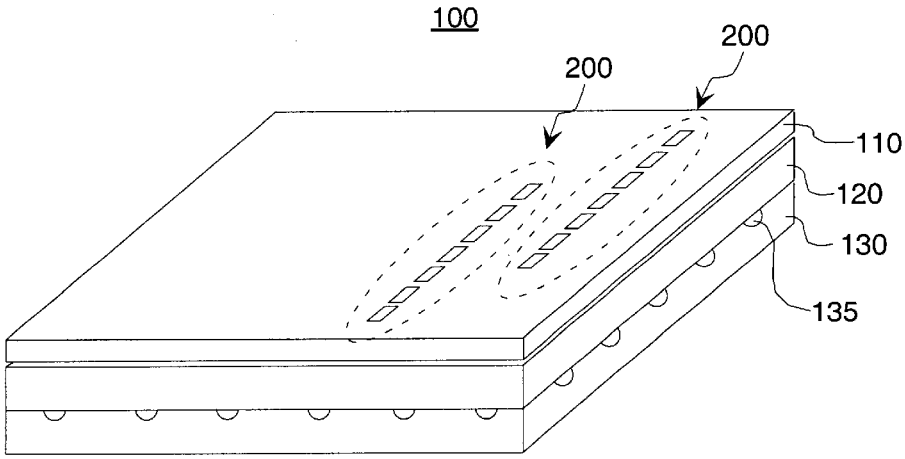
FIG. 1 is a perspective view of an embodiment of the present invention showing an antenna substrate incorporating the reconfigurable antenna array, an optical transmission structure layer, and an optical source layer.

FIG. 1 shows a reconfigurable antenna array 100 according to an embodiment of the present invention. Reconfigurable antenna array 100 comprises a plurality of reconfigurable dipole antenna elements 200 formed on a surface of an antenna substrate 110, an optical transmission structure layer 120 disposed below the antenna substrate 110, and an optical source layer 130. Preferably, the optical transmission structure layer 120 comprises a high-impedance electromagnetically reflective structure. The high-impedance electromagnetically reflective structure may be of the type disclosed in WO9950929 and briefly discussed above.

Reconfiguration of the antenna elements 200 is provided by RF MEMS switches (not shown in FIG. 1) on the antenna substrate 110 coupling individual segments of the elements 200. The antenna elements 200 and the RF MEMS switches are formed on the underside of the antenna substrate 110 to allow the antenna elements 200 to be closely positioned to the optical transmission structure layer 120 and to allow the switches to be illuminated by optical energy provided by optical sources in the optical source layer 130. While only two representative antenna elements 200 are illustrated in FIG. 1, it is to be understood that the number of elements actually used in a particular application will depend on the particular requirements of that application. Many applications will require large antenna arrays with hundreds or even thousands of antenna elements. Also, antenna configurations comprising antenna elements other than dipole elements, such as slot antenna elements or arrays of patch antennas, are provided by other embodiments of the present invention.

Figure 2:
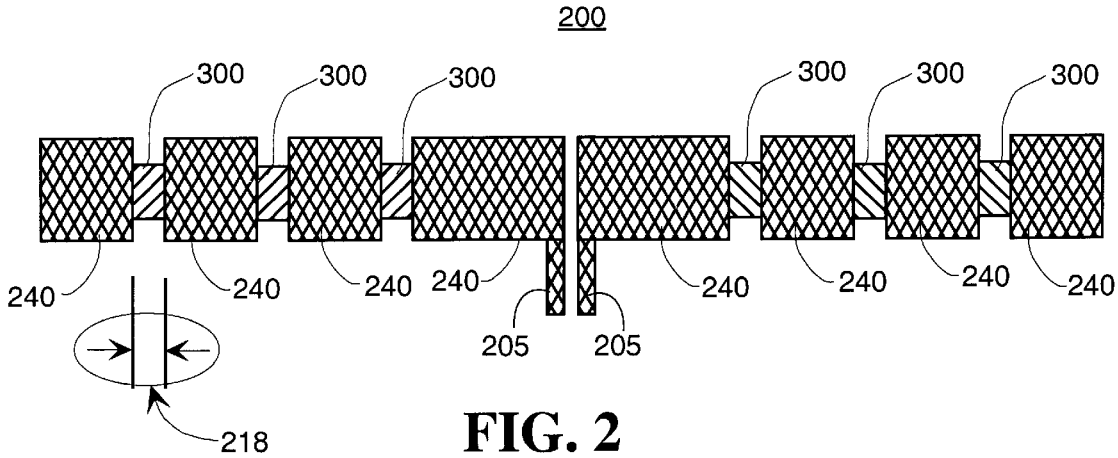
FIG. 2 shows a representative reconfigurable dipole antenna element.

FIG. 2 shows, in greater detail, a representative reconfigurable dipole antenna element 200 of antenna array 100. Antenna element 200 comprises a twin antenna feed structure 205, a radiating structure comprising series of adjacent metal strip segments 240 formed on the substrate 110 (not shown in FIG. 2) and extending to either side of feed structure 205, and RF MEMS switches 300 that electrically connect together each successive pair of adjacent metal strip segments 240. Gaps 218 separate adjacent metal strip segments 240. The gaps 218 between adjacent metal strip segments 240 are electrically bridged by the RF MEMS switches 300, in a manner to be explained later.

Figure 3:
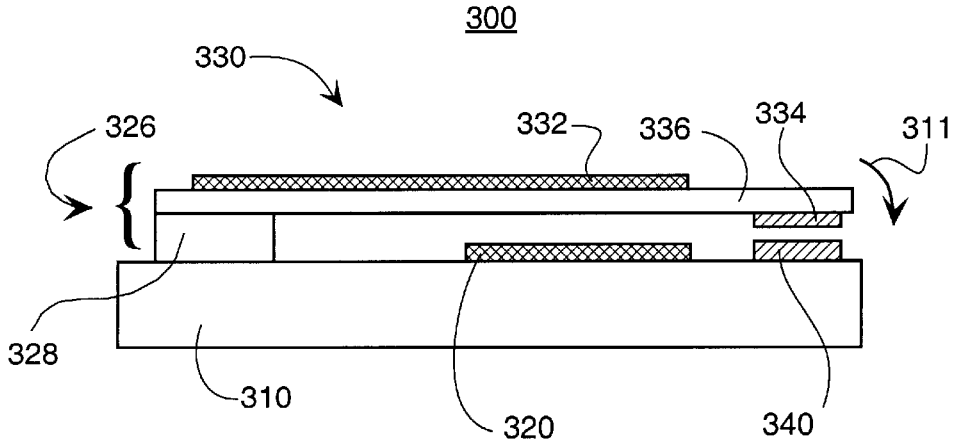
FIG. 3 shows a cross-sectional view of a representative RF MEMS switch for use in the present invention.

FIG. 3 shows one form of an RF MEMS switch, which may be incorporated into the present invention. Embodiments of applicable RF MEMS switches are described in greater detail in pending U.S. patent application Ser. No. 09/429,234, incorporated herein by reference. The RF MEMS switch, generally designated 300, is fabricated using generally known microfabrication techniques, such as masking, etching, deposition, and lift-off. In the preferred embodiment, RF MEMS switches 300 are directly formed on the antenna substrate 110 and monolithically integrated with the metal segments 240. Alternatively, the RF MEMS switches 300 may be discreetly formed and then bonded to antenna substrate 110. Referring once more to FIG. 2, one RF MEMS switch 300 is positioned proximate each gap 218 between pairs of adjacent metal segments 240 formed on the substrate 110.

As seen in FIG. 3, the switch 300 comprises a substrate electrostatic plate 320 and an actuating portion 326. The substrate electrostatic plate 320 (typically connected to ground) is formed on the MEMS substrate 310. The substrate electrostatic plate 320 generally comprises a patch of a metal not easily oxidized, such as gold, for example, deposited on the MEMS substrate 310. Actuation of the switch 300 electrically disconnects and connects the adjacent metal segments 240 to open and close the gap 218, in a manner to be explained later. The MEMS substrate 310 preferably comprises semi-insulating material with photoconductive properties.

The actuating portion 326 of the switch 300 comprises a cantilever anchor 328 affixed to the MEMS substrate 310, and an actuator arm 330 extending from the cantilever anchor 328. The actuator arm 330 forms a suspended micro-beam attached at one end to the cantilever anchor 328 and extending over and above the substrate electrostatic plate 320 and over and above electrical contacts 340, 341. The cantilever anchor 328 may be formed directly on the MEMS substrate 310 by deposition buildup or by etching away surrounding material, for example. Alternatively, the cantilever anchor 328 may be formed with the actuator arm 330 as a discrete component and then affixed to the MEMS substrate 310. The actuator arm 330 may have a bilaminar cantilever (or bimorph) structure. Due to its mechanical properties, the bimorph structure exhibits a very high ratio of displacement to actuation voltage. That is, a relatively large displacement (approximately 300 micrometers) can be produced in the bimorph cantilever in response to a relatively low switching voltage (approximately 20 V).

A first layer 336 of the actuator arm structure comprises a semi-insulating or insulating material, such as polycrystalline silicon. A second layer 332 of the actuator arm structure comprises a metal film (typically aluminum or gold) deposited atop first layer 336. The second layer 332 typically acts as an electrostatic plate during operation of the switch. In the remainder of the description, the terms "second layer" and "arm electrostatic plate" will be used interchangeably. As shown in FIG. 3, the second layer 332 is coupled to the cantilever anchor 328 and extends from the cantilever anchor 328 toward the position on the actuator arm 330 at which electrical contact 334 is formed. Since the height of the cantilever anchor 328 above the MEMS substrate 310 can be tightly controlled using known fabrication methods, locating the second layer 332 proximate the cantilever anchor 328 enables a correspondingly high degree of control over the height of the second layer 332 above the MEMS substrate 310.

The switch actuation voltage is dependent upon the distance between the substrate electrostatic plate 320 and the arm electrostatic plate 332, so a high degree of control over the spacing between the electrostatic plates is necessary in order to repeatably achieve a desired actuation voltage. In addition, at least a portion of the second layer 332, comprising the arm electrostatic plate, and a corresponding portion of the actuator arm 330, on which second layer 332 is formed, are positioned above the substrate electrostatic plate 320 to form an electrostatically actuatable structure. An electrical contact 334, typically comprising a metal that does not oxidize easily, such as gold, platinum, or gold palladium, for example, is formed on the actuator arm 330 and positioned on the arm so as to face the electrical contacts 340, 341 disposed on the MEMS substrate 310. The electrical contacts 340, 341 are electrically coupled to the adjacent metal segments 240 so that the adjacent metal segments 240 are electrically connected when the switch 300 is closed, and are electrically isolated when the switch 300 is open.

Figure 4:
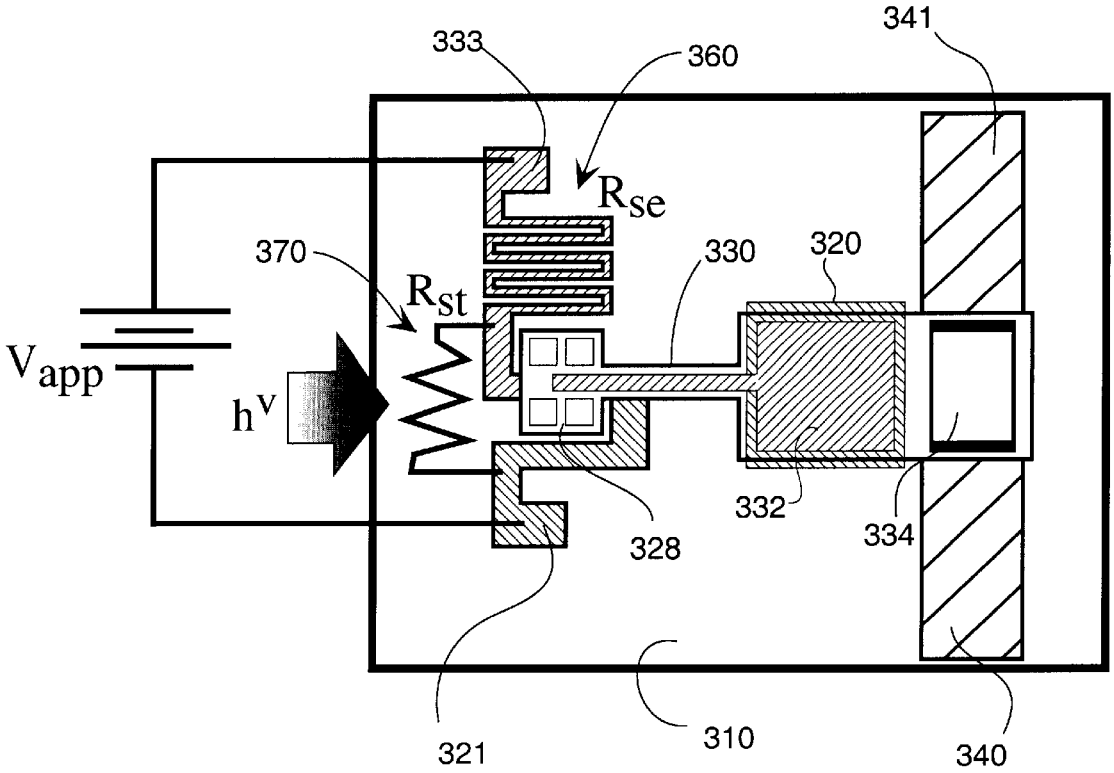
FIG. 4 shows a top-down view of the RF MEMS switch depicted in FIG. 3 with a schematic representation of the elements providing control over the switch.

FIG. 4 provides a top-down view of the RF MEMS switch shown in FIG. 3 and also illustrates schematically the operation of the switch. A voltage source $V_{app}$ is coupled to the RF MEMS switch 300. The voltage source $V_{app}$ is coupled to a substrate plate contact 321 and an arm plate contact 333. The arm plate contact 333 is connected to the electrostatic arm plate 332 through a resistive path 360 disposed on the substrate having a resistance vale of $R_{se}$. The resistive path 360 may comprise sputtered CrSiO in a 6 micron line width, and conducts current from the arm plate contact 333 to the electrostatic arm plate 332 through an appropriate resistance of preferably about 1 megohm. The substrate plate contact 321 is electrically connected with the substrate electrostatic plate 20. When voltage $V_{app}$ is applied across the switch contacts 321, 333 and, correspondingly, across substrate and arm electrostatic plates 320 and 332, the RF MEMS switch 300 is closed by means of this electrostatic attraction between the substrate electrostatic plate 320 located on the MEMS substrate 310 and the arm electrostatic plate 332 located on actuator arm 330.

When the switch 300 is in the open state, the adjacent metal segments 240 constituting dipole antenna element 200 are electrically isolated from each other. When voltage $V_{app}$ is applied across the electrostatic plates 320 and 332, the arm electrostatic plate 332 is attracted electrostatically toward substrate electrostatic plate 320, forcing actuator arm 330 to deflect toward the MEMS substrate 310. Deflection of the actuator arm 330 toward the substrate electrostatic plate 320, in the direction indicated by arrow 311 in FIG. 3, causes the electrical contact 334 to come into contact with the electrical contacts 340, 341, thereby electrically bridging the gap 218 between the metal segments 240. The voltage required close the RF MEMS switch 300 may be as low as 7 V or lower depending upon the sizes of the electrostatic plates 320, 332 and the materials used to fabricate the arm 330.

The substrate electrostatic plate 320 and arm electrostatic plate 332 are insulated from the metal segments 240 constituting antenna element 200, and the electrostatic plates 320, 332 are dielectrically isolated, even when the switch 300 is closed. Thus, only the application of a voltage difference between the plates 320, 332 actuates the switch 300 and no steady-state bias current is needed for the switch 300 to operate. Also, since no steady DC current flows from the applied voltage (only a transient current that builds up an electric field across the electrostatic plates), only a low current voltage source is required.

The opening of the RF MEMS switches 300 in order to reconfigure dipole antenna element 200 will now be discussed. When actuation voltage $V_{app}$ is applied to RF MEMS switch 300, the voltage $V_{SA}$ appearing across substrate electrostatic plate 320 and arm electrostatic plate 332 is given by the relationship $$V_{SA}=V_{app}R_{st}/(R_{st}+R_{se})$$

where $R_{St}$ is the resistance of semi-insulating substrate 110 between the substrate electrostatic plate 320 and arm electrostatic plate 332 (represented as the resistor 370 shown in FIG. 4), and $R_{Se}$ is the resistive path 360. When the RF MEMS switch 300 is not illuminated, $R_{St}$ is much larger than the series resistance $R_{Se}$, so that almost the entire voltage produced by the applied voltage $V_{app}$ appears across the RF MEMS switch electrostatic plates 320, 332.

However, a semi-insulating substrate, comprising a substance such as gallium arsenide or polycrystalline silicon, is photoconductive. Thus, when optical energy $h^{\nu}$ illuminates the portion of the semi-insulating MEMS substrate 310 insulating the RF MEMS switch substrate electrostatic plate 320 from the RF MEMS switch arm electrostatic plate 332, the optical energy $h^{\nu}$ transferred to MEMS substrate 310 causes a proportion of the outer valence electrons of the substrate's constituent atoms to break free of their atomic bonds, thus creating free carriers. These free electrons are capable of carrying an electric current. Thus, when the RF MEMS switch 300 is illuminated, $R_{St}$ is reduced by the photoconducting process and becomes much lower than $RS_{Se}$. Consequently, the voltage drop across the electrostatic plates falls below the level required to close the RF MEMS switch 300, causing the switch 300 to open, and interrupting the connection between adjacent metal segments 240 and changing the resonant length of dipole antenna element 200.

Figure 5:
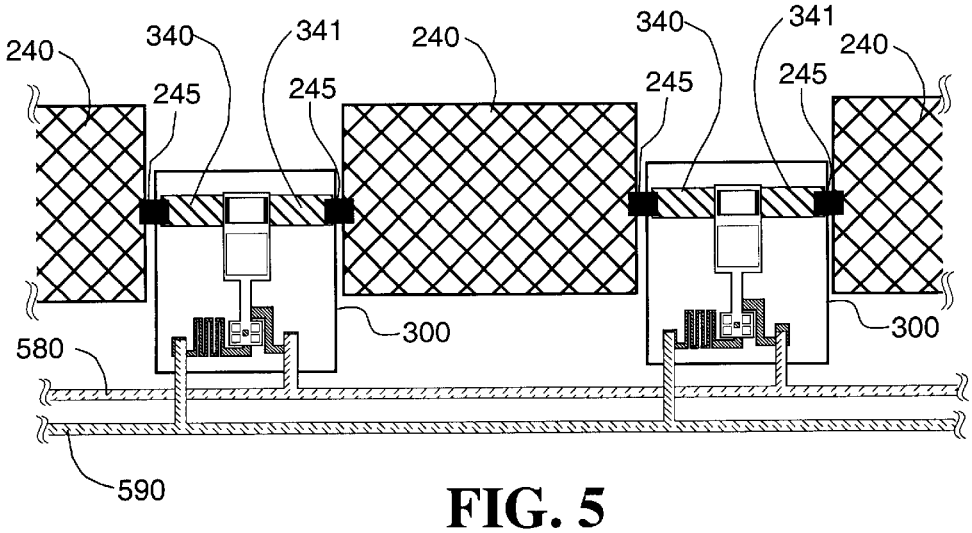
FIG. 5 shows the coupling of multiple antenna segments with RF MEMS switches.

FIG. 5 shows a view from below of two RF MEMS switches 300 disposed to electrically couple three metal segments 240. The switches 300 electrically bridge the gaps between the segments 240 in the manner described above. In FIG. 5, the electrical contacts 340, 341 of the switches are shown to be electrically connected to the metal segments 240 by metal contacts 245. The metal contacts 245 may comprise solder connections, deposited metal, or other electrically connecting means known in the art. Note also that microfabrication techniques may be used to integrally fabricate the electrical contacts 340, 341 of the RF MEMS switches 300 and the metal segments 240, thus obviating the need for the separate electrical contacts 245 between the RF MEMS switch electrical contacts 340, 341 and the metal segments 240. FIG. 5 also shows the bias lines 580, 590 used to provide the bias voltage for actuating the RF MEMS switches 300. In FIG. 5, the bias lines 580, 590 are shown disposed to the side of the RF MEMS switches 300 for clarity purposes only. The bias lines 580, 590 are preferably disposed directly beneath the RF MEMS switches 300 to shorten the connections to the RF MEMS switches 300. As described below, the majority of bias lines 580, 590 are preferably disposed beneath a shielding ground plane so as to minimize RF coupling effects between the bias lines 580, 590 and the antenna elements 200. FIG. 5 shows a single pair of bias lines coupled to the RF MEMS switches 300, wherein a single voltage source may be used to actuate all RF MEMS switches 300 in an array. Alternative embodiments of the present invention may each have individually controllable bias lines connected to each RF MEMS switch 300 in the antenna array.

Figure 6:
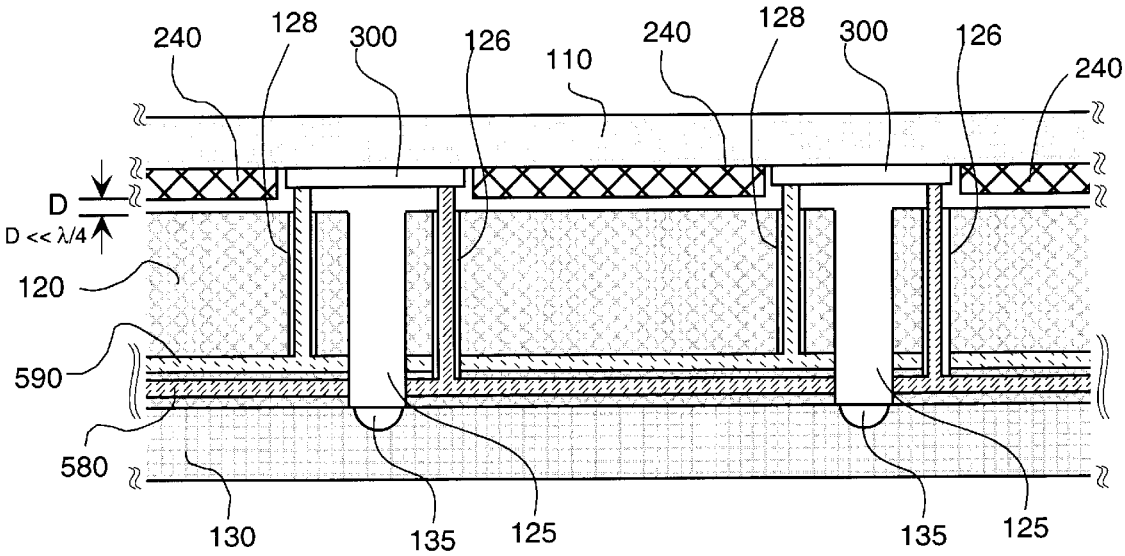
FIG. 6 is a cross-sectional view of the antenna substrate, the optical transmission structure layer, and the optical source layer that illustrates the vias used to connect to the RF MEMS switches.

FIG. 6 shows a cross-sectional view of the various layers of the preferred embodiment of the present invention. FIG. 6 shows the metal segments 240 and the RF MEMS switches 300 disposed on the bottom side of the antenna substrate 110. The antenna substrate 110 preferably comprises a material that minimally affects the coupling of electromagnetic energy to the metal segments 240. The antenna substrate 110 may comprise either a semi-insulating material or a dielectric material, and may be fabricated from materials typically used to construct printed circuit boards (PCBs). Alternatively, the RF MEMS switches 300 may be integrated with the antenna substrate 110, as previously discussed, so that the antenna substrate 110 and the MEMS substrate 310 comprise the same materials.

Beneath the antenna substrate 110 is the optical transmission structure layer 120. If the optical transmission structure layer 120 comprises a high-impedance electromagnetically reflective surface, the optical transmission structure layer 120 will minimize the phase shift in electromagnetic waves, upon reflection, which allows the gap, with distance D, between the metal segments 240 and the high impedance surface layer 120 to be minimized. As discussed above, a high-impedance electromagnetically reflective surface allows the gap distance D to be much less than one quarter wavelength of the lowest operating frequency of the antenna. However, the metal segments 240 should not contact a high-impedance electromagnetically reflective surface, since this will effectively short all of the segments 240 together. The gap may simply be an air gap, where the antenna substrate 110 is supported above the high impedance surface by non-conductive structures distributed over the surface of the high impedance surface. Alternatively, the gap may comprise a layer of dielectric thin film material, such as a thin layer of polysilica or plastic, fabricated to support the antenna substrate and providing space for the RF MEMS switches to open and close, while electrically insulating the metal segments 240 from the high-impedance electromagnetically reflective surface.

The optical transmission structure layer 120 may contain bias line via holes 126, 128 that allow the bias voltage to be applied to each RF MEMS switch 300 by the bias lines 580, 590, while ensuring that the lengths of the bias lines 580, 590 that protrude above the surface of the optical transmission structure layer 120 are minimized. FIG. 6 shows the bias lines 580, 590 horizontally disposed at the lower portion of the optical transmission structure layer 120 and vertically connecting through the optical transmission structure layer 120 to the RF MEMS switches 300. Alternative embodiments of the present invention may dispose the bias lines 580, 590 in the optical source layer 130, or the bias lines 580, 590 may be separately disposed in a bias line layer (not shown in FIG. 6) located beneath the optical transmission structure layer 120 or the optical source layer 130, and vertically connecting through via holes 126, 128 to the RF MEMS switches 300. Preferably, the bias lines 580, 590 are shielded from the metal segments 240 by a ground plane. As discussed earlier, a high-impedance electromagnetically reflective surface acts as a ground plane and, thus, may be used to shield the bias lines 580, 590 from the metal segments 240.

The bias line via holes 126, 128 may be provided by fabricating the layer 120 with the requisite holes, drilling through the optical transmission structure layer 120, or using any other means known in the art to create holes through the optical transmission structure layer 120. If the optical transmission structure layer 120 comprises electrically conductive portions, insulating material may be used within the bias line via holes 126, 128 or as part of the via holes 126, 128 themselves to electrically isolate the bias lines 580, 590 from the optical transmission structure layer 120

The optical source layer 130 comprises a plurality of substrate illuminating optical energy sources 135 used to open the RF MEMS switches in the manner described above. Optical energy is coupled to the RF MEMS switches by optical via holes 125 contained within the optical transmission structure layer 120 (and any other layers between the optical sources and the RF MEMS switches). Note, in FIG. 6, the bias lines 580, 590 are shown disposed behind the optical via holes 125. Alternative positions of the bias lines 580, 590 in relation to the optical via holes 125 may also be used. As discussed above, illumination of the semi-insulating substrate 310 by an optical energy source causes the RF MEMS switches 300 to open, thus providing control over the inter-segment coupling of the metal segments 240 disposed on the antenna substrate 110. The optical source layer 130 may comprise an active matrix optical source, such as that provided by commercially available active matrix LED or LCD panels. The optical via holes 125 may be provided by fabricating the optical transmission structure layer 120 with the requisite holes, drilling through the optical transmission structure layer 120, or using any other means known in the art to create holes through the optical transmission structure layer 120. Each optical via hole 125 may simply comprise an opening in the optical transmission structure layer 120, or a tube or other light directing means, such as optical lenses, optical fibers, etc., may be used to direct or focus light on the RF MEMS switch 300 that corresponds to each individual optical source 135.

In operation, the bias lines 580, 590 preferably provide a bias voltage to every RF MEMS switch 300 in the antenna. Application of this bias voltage will cause every RF MEMS switch to initially be in the closed state. The optical energy sources 135 in the optical source layer 130 are then individually controlled to selectably provide optical energy to each corresponding RF MEMS switch 300. The optical energy will be transmitted through the optical via hole 125 and directed onto the corresponding RF MEMS switch 300. Transmission of the optical energy onto the MEMS substrate 310 will cause the switch to open, thus effectively reconfiguring the metal segments 240 coupled by the switches 300. Commercial optical light matrix products built with random access brightness control, such as an active matrix LED panel, a liquid crystal display (LCD) panel used for notebook computers, may serve as the controllable matrixed light source for controlling the array of RF MEMS switches 300.

Figure 7:
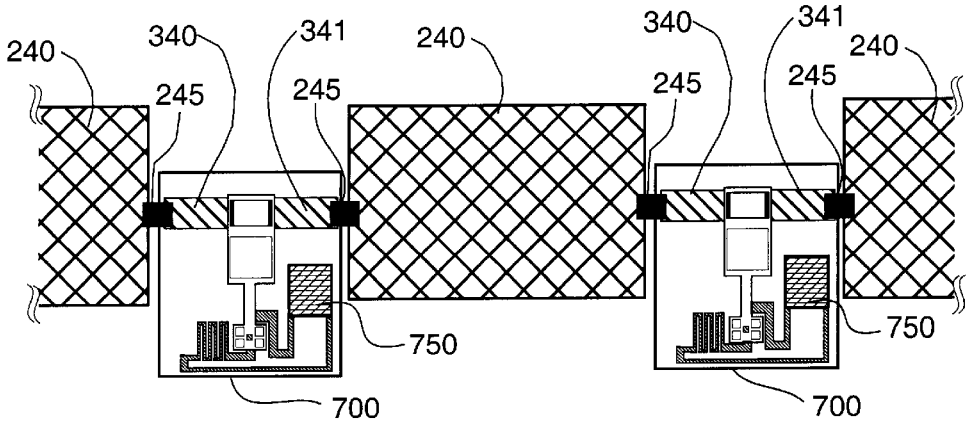
FIG. 7 shows the coupling of multiple antenna segments with RF MEMS switches having photo-voltaic cells providing bias voltages.

An alternative embodiment of the present invention provides for the elimination of the DC bias lines and, instead, uses a photo-voltaic cell to provide the necessary voltage for closing the RF MEMS switch. FIG. 7 shows an RF MEMS switch 700 coupled to metal segments 240, where the RF MEMS switch 700 comprises the same elements of the RF MEMS switch earlier described, except that a photo-voltaic cell 750 is coupled to the arm plate contact 333 and the substrate plate contact 321 is used to provide a bias voltage in place of the bias lines earlier described. As is known in the art, a photo-voltaic cell will produce a voltage when illuminated by optical energy. Hence, as shown in FIG. 7, the photo-voltaic cell 750 may act in place of bias lines to provide the actuating voltage required to close the RF MEMS switch 700. When the photo-voltaic cell 750 is illuminated, a bias voltage providing electrostatic attraction between the arm electro-static plate and the substrate electro-static plate of the switch 700 is created, which causes the switch 700 to close. Illumination of the switch substrate will still cause the resistance between the arm electro-static plate and the substrate electro-static plate to lessen, and will cause the switch to open.

Figure 8:
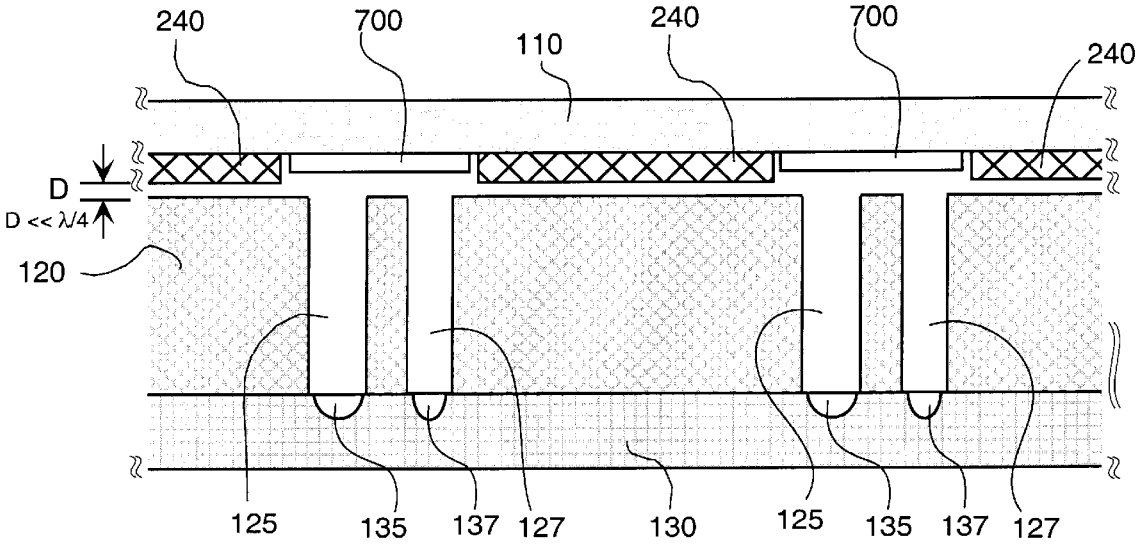
FIG. 8 is a cross-sectional view of the antenna substrate, the optical transmission structure layer, and the optical source layer that illustrates the optical vias used to control the RF MEMS switches depicted in FIG. 7.

FIG. 8 shows a cross-sectional view of the various layers of the embodiment depicted in FIG. 7. The antenna substrate 110 and the optical transmission structure layer 120 may comprise the same structure and materials as earlier discussed. As discussed above, this embodiment does not require DC bias lines and, therefore, no DC bias line vias are required. Instead, a second optical via hole 127 is provided to couple optical energy from a photo-voltaic cell optical source 137 to the photo-voltaic cell 750 located on the antenna substrate 110. The optical source layer 130 may provide the substrate illuminating optical sources 125 and the photo-voltaic cell optical sources 137 using devices well-known in the art, such as the LED or LCD panels described above, or a second layer (not shown in FIG. 8) may be used to provide a separate source for the photo-voltaic cell optical sources 137. Individually controllable photovoltaic cell optical sources 137 may be used, but are not required, since the substrate illuminating optical sources 125 provide control over the opening and closing of the RF MEMS switches.

Figure 9:
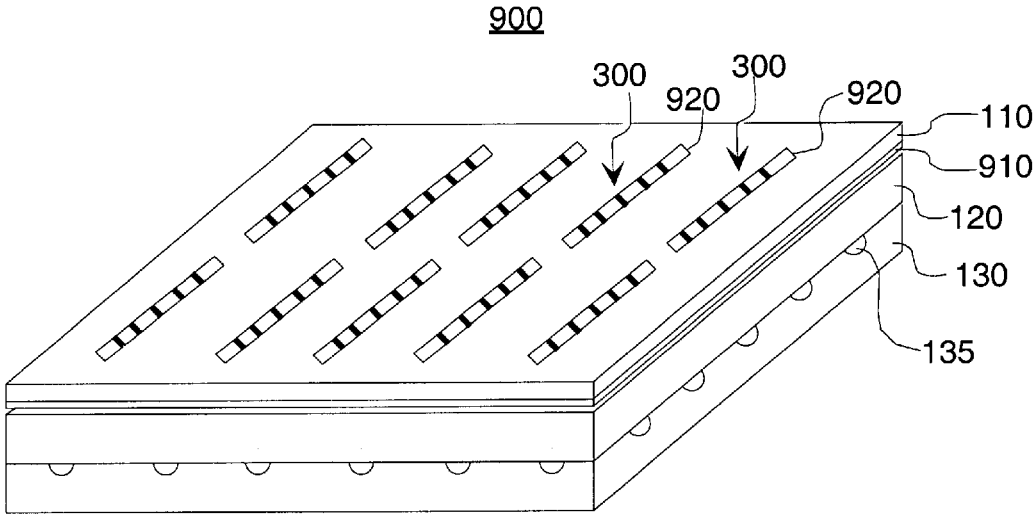
FIG. 9 is a perspective view of an embodiment of the present invention using slot antenna elements.

Other embodiments of the present invention provide for the reconfiguration of antenna arrays comprising slot antenna elements. FIG. 9 shows an antenna array 900 comprising a plurality of slot antenna elements 920 with RF MEMS switches 300 disposed within the slot elements 920. While only a few slot antenna elements 920 oriented in a parallel configuration are shown in FIG. 9, it is to be understood that the number of slot antenna elements used in a slot antenna array and the orientation of the slot elements will depend upon the particular requirements of the antenna array. Many slot antenna arrays may comprise hundreds or thousands of individual slot antenna elements.

In FIG. 9, the slot antenna elements 920 comprise slots fabricated within a ground plane layer 910. Similar to previous described embodiments of the present invention, the antenna substrate layer 110 is disposed above the slot antenna elements 920. The RF MEMS switches 300 may be formed as an integrated part of the antenna substrate 110 or may be disposed on the substrate 110 as discrete components. The optical transmission structure layer 120 is disposed beneath the ground plane layer 910 to provide a reflective surface for the slot antenna elements 920 and to shield RF and electrical connections to the slot antenna elements 920 and the RF MEMS switches 300. The RF MEMS switches are illuminated from optical sources in the optical source layer 130 in the manner previously described.

Figure 10:
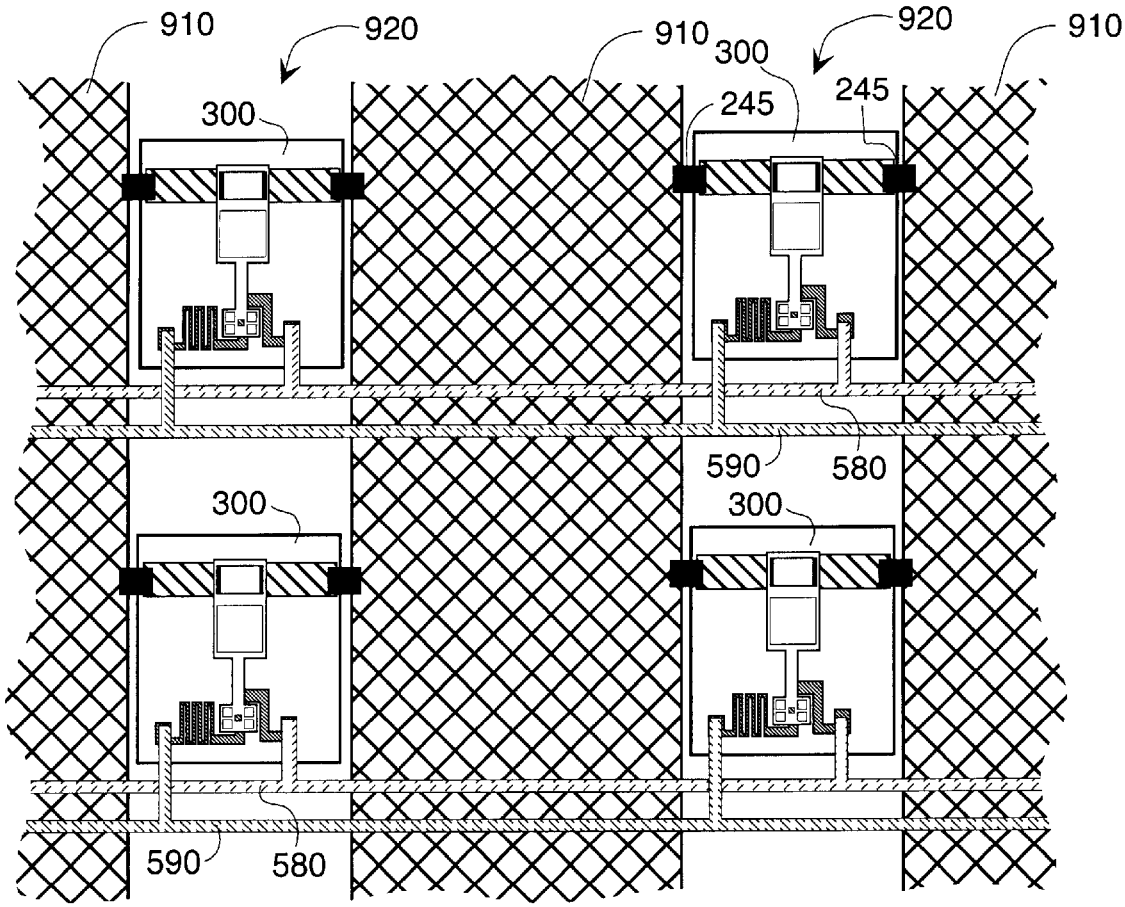
FIG. 10 shows a portion of a ground plane having slot antenna elements in which RF MEMS switches are used to reconfigure the slot antenna elements.

FIG. 10 shows a view of a portion of the ground plane layer 910 on which four RF MEMS switches 300 are disposed to reconfigure two slot antenna elements 920. The RF MEMS switches 300 electrically connect one side of an RF slot antenna element 920 to the other side of the slot element 920, effectively shorting, and thus, shortening the element 920 at that point. Metal contacts 245 may be used to connect the electrical contacts 340, 341 of the RF MEMS switches 300 to opposite sides of the slot antenna element 920, or the ground plane layer 910 and the RF MEMS switches 300 may be formed such that the electrical contacts 340, 341 are integral with the ground plane layer 910. The bias lines 580, 590 are used to provide the bias voltages used for actuating the RF MEMS switches. The bias lines 580, 590 may be disposed directly beneath, but electrically isolated from, the ground plane layer 910, or disposed in the manner previously described for other embodiments of the present invention. Alternative embodiments of the present invention actuate the RF MEMS switches 300 in the slot antenna elements 920 by using optical energy directed into a photo-voltaic cell, as previously discussed.

Thus, the reader will see that the present invention provides reliable actuation of switches in a reconfigurable antenna without the need for an intricate network of metallic bias lines proximate the antenna elements.

A larger antenna array may be created by combining smaller antenna subarrays according to the present invention. The smaller subarrays comprise modules with the the antenna substrate 110, the optical transmission structure layer 120, and the optical source layer 130 discussed above. The modules may then be connected and assembled together to form a larger array which has a common high-impedance backplane. A coarse reconfiguration of the resulting larger array can be achieved by using MEMS switches or hard-wire switch connections between the modules, and the individual modules can be controlled to change the final dimension of the antenna elements for the desired frequency band of operation. An individual module or a plurality of modules may be used to fabricate known reflective antenna topologies, such as a Cassegrain reflective antenna.

Figure 11A:
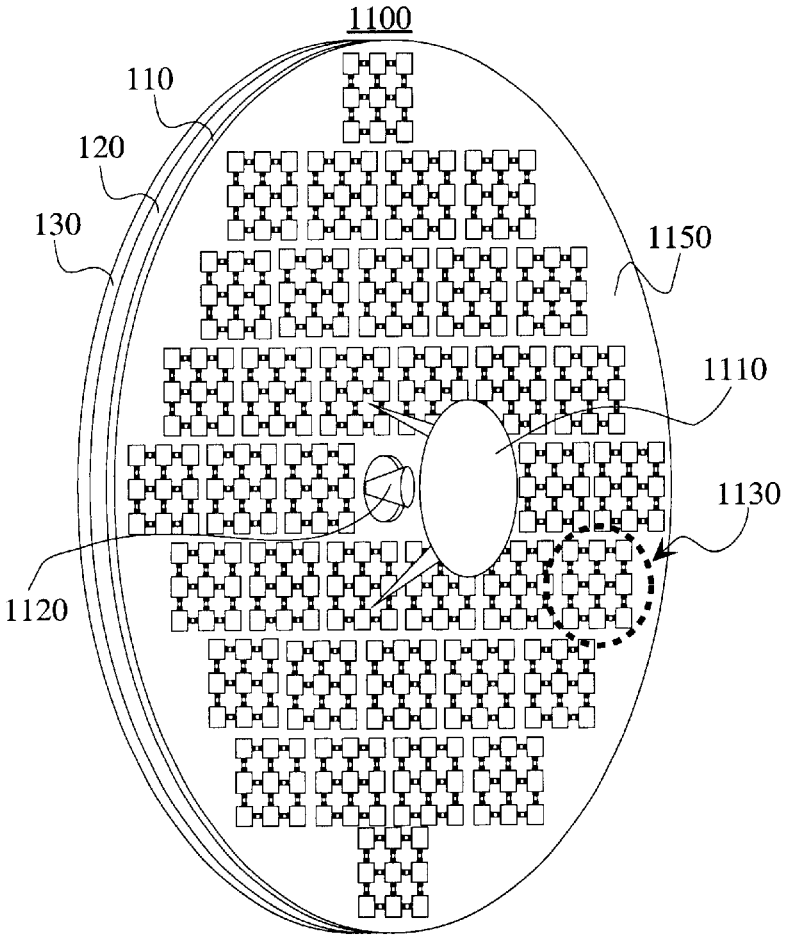
FIG. 11A shows a Cassegrain antenna using arrays of reconfigurable antenna subarrays according to the present invention.

FIG. 11A shows the combination of multiple antenna subarrays 1130 to form a Cassegrain antenna 1100. The Cassegrain antenna 1100 comprises a curved backplate 1150 on which a plurality of the antenna subarrays 1130 are disposed to form the primary reflector of the antenna. A secondary reflector 1110 is positioned in front of the antenna subarrays to direct radio frequency energy to and from a feed horn 1120. The curved backplate 1150 may comprise the antenna substrate 110, the optical transmission structure layer 120, and the optical source layer 130 previously discussed, or the curved backplate 1150 may simply provide a structural foundation for those layers. The Cassegrain antenna 1100 may also use a flat backplate or other shapes for the backplate, in which additional elements are used to direct the radiation from the antenna elements on the backplate to and from the secondary reflector 1110.

Figure 11B:
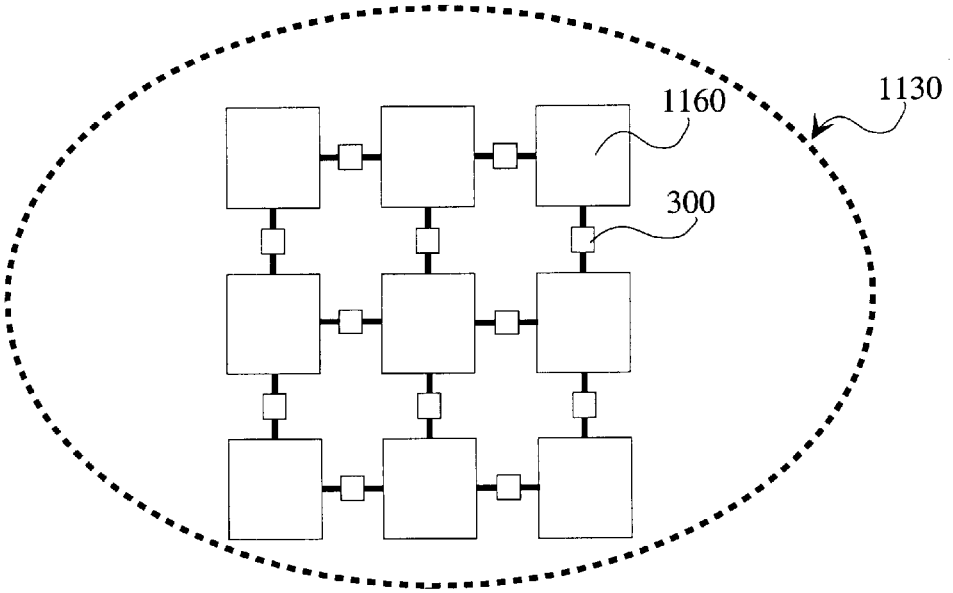
FIG. 11B shows an enlarged view of a representative antenna subarray used in the Cassegrain antenna depicted in FIG. 11A.

The antenna subarrays 1130 of the Cassegrain antenna shown in FIG. 11A comprise a matrix of nine patch antenna elements 1160 interconnected by RF MEMS switches 300, as shown in FIG. 11B. This configuration of patch antenna elements 1160 is provided for explanation purposes only. The antenna subarrays 1130 may comprise any number of antenna elements interconnected by RF MEMS switches in multiple configurations. The antenna elements may also be dipole antenna elements, slot antenna elements, or other antenna elements known in the art.

Although the present invention has been described with respect to specific embodiments thereof, various changes and modifications can be carried out by those skilled in the art without departing from the scope of the invention. For example, other configurations of reconfigurable antenna subarrays and antenna arrays beyond those described herein may be provided by other embodiments of the present invention. It is intended, therefore, that the present invention encompass such changes and modifications as fall within the scope of the appended claims.

What is claimed is:

1. A method for optically controlling an electromagnetic configuration of an antenna array element comprising the steps of:

providing a plurality of electrically-actuated mechanical switches for connecting sub-elements of the antenna array;

providing at least one optically sensitive electric control element to control actuation of at least one corresponding switch of the plurality of mechanical switches;

providing an optical transmission structure having regions which are optically transmissive from a first side of the optical transmission structure to a second side of the optical transmission structure;

disposing the antenna array element in a predetermined position on the first side of the optical transmission structure;

disposing a source of selectably controllable optical energy on the second side of the optical transmission structure;

selectively controlling the optical energy to illuminate a particular optically sensitive control element through a transmissive region of the optical transmission structure, thereby changing a position of a corresponding switch to change the configuration of the antenna array element.

2. The method of claim 1 wherein the optical transmission structure comprises a high-impedance electromagnetically reflective surface.

3. The method of claim 2 wherein the step of providing a transmission structure includes providing an insulator layer between said reflective surface and the antenna array element.

4. The method of claim 3 including the step of disposing the reflective surface less than one quarter wavelength of the antenna operating frequency away from the antenna array element.

5. The method of claim 1 including the step of providing a bias voltage to enable actuation of at least one of the mechanical switches to a first position.

6. The method of claim 5 wherein the step of providing a bias voltage includes conducting the bias voltage through the optical transmission structure.

7. The method of claim 5 wherein the step of providing a bias voltage includes the step of controlling the source of optical energy to illuminate a photovoltaic array.

8. The method of claim 5 wherein the step of providing an optically sensitive control element includes providing at least one photoresistive element, and including the further step of controlling the source of optical energy to illuminate the photoresistive element and thereby cause the mechanical switch to change to a second position.

9. The method of claim 8 wherein the step of providing the photoresistive element includes forming the photoresistive element in a substrate on which the switch is formed.

10. The method of claim 1 wherein said regions which are optically transmissive comprise tubes passing through the optical transmission structure to transmit optical energy to the optically sensitive control elements.

11. The method of claim 1 wherein the antenna array element is an element selected from the group consisting of dipole antenna elements, patch antenna elements, and slot antenna elements.

12. A reconfigurable antenna array comprising:

an array of antenna subelements;

a plurality of microelectromechanical system (MEMS) switches selectably connecting adjacent antenna subelements;

a plurality of optically sensitive elements, each optically sensitive element controlling a corresponding MEMS switch;

a matrix of optical power controlling elements selectably illuminating each optically sensitive element; and an optical transmission layer, wherein the matrix of optical power controlling elements direct optical power to enter a transmissive region of the optical transmission layer on a first side thereof, and wherein the plurality of optically sensitive elements are on a second side of the optical transmission layer.

13. The reconfigurable antenna array of claim 12 including a bias voltage source for providing a bias voltage to actuate each of the MEMS switches into a first condition.

14. The reconfigurable antenna array of claim 13 wherein electrical resistance of an optically sensitive element of a selected MEM switch is lowered upon illumination to cause the selected MEM switch to actuate into a second condition.

15. The reconfigurable antenna array of claim 13 wherein the bias voltage source is a photovoltaic array illuminated under control of the matrix of optical power controlling elements.

16. The reconfigurable antenna array of claim 15 wherein the photovoltaic array is illuminated to actuate all the MEMS switches into a first condition.

17. The reconfigurable antenna array of claim 13 wherein the bias voltage source actuates all the MEMS switches into a first condition in an absence of illumination.

18. The reconfigurable antenna array of claim 17 wherein the reflective layer is located less than one quarter wavelength of an antenna operating frequency from the array of subelements.

19. The reconfigurable antenna array of claim 12, wherein said antenna array further comprises a substrate layer on which said plurality of MEMS switches and said array of subelements are disposed, and said optical transmission layer comprises:

a high-impedance electromagnetic reflective layer; and an insulating material layer disposed between said subelements and said reflective layer.

20. The reconfigurable antenna array of claim 19 wherein the optically transmissive regions of the transmission layer include apertures through the optical transmission structure.

21. The reconfigurable antenna array of claim 20 wherein at least one of the apertures is electrically conductive and conducts a bias voltage to at least one of the MEM switches.

22. The reconfigurable antenna array of claim 20 wherein the optical transmission layer comprises a multilayer printed circuit board and the optical apertures are vias through the multilayer printed circuit board.

23. The reconfigurable antenna array of claim 12, wherein the array comprises one of a plurality of subarray modules.

24. The reconfigurable antenna array of claim 23, wherein the plurality of subarray modules are configured to provide the primary reflector of a Cassegrain antenna.

25. The reconfigurable antenna array of claim 12, wherein the antenna subelements is an antenna element selected from the group consisting of dipole antenna elements, patch antenna elements, and slot antenna elements.

26. A method for optically controlling an electromagnetic configuration of an antenna array element comprising the steps of:

providing a plurality of electrically-actuated mechanical switches for connecting sub-elements of the antenna array;

providing at least one optically sensitive electric control element to control actuation of at least one corresponding switch of the plurality of mechanical switches;

providing a high-impedance electromagnetically reflective structure having regions which are optically transmissive from a first side of the reflective structure to a second side of the reflective structure;

disposing the antenna array element in a predetermined position on the first side of the reflective structure;

disposing a source of selectably controllable optical energy on the second side of the reflective structure;

selectively controlling the optical energy to illuminate a particular optically sensitive control element through a transmissive region of the reflective structure, thereby changing a position of a corresponding switch to change the configuration of the antenna array element.

27. The method of claim 26 including the step of providing a bias voltage to enable actuation of at least one of the mechanical switches to a first position.

28. The method of claim 27 wherein the step of providing a bias voltage includes conducting the bias voltage through the reflective structure.

29. The method of claim 27 wherein the step of providing a bias voltage includes the step of controlling the source of optical energy to illuminate a photovoltaic array.

30. The method of claim 27 wherein the step of providing an optically sensitive control element includes providing at least one photoresistive element, and including the further step of controlling the source of optical energy to illuminate the photoresistive element and thereby cause the at least one mechanical switch to change to a second position.

31. The method of claim 30 wherein the step of providing the photoresistive element includes forming the photoresistive element in a substrate on which the at least one mechanical switch is formed.

32. The method of claim 26 wherein said regions which are optically transmissive comprise tubes passing through the reflective structure to transmit optical energy to the optically sensitive control elements.

33. The method of claim 26 wherein the step of providing a reflective structure includes providing an insulator layer between said reflective structure and the antenna array element.

34. The method of claim 33 including the step of disposing the reflective structure less than one quarter wavelength of the antenna operating frequency away from the antenna array element.

35. The method of claim 26 wherein the antenna array element is an element selected from the group consisting of dipole antenna elements, patch antenna elements, and slot antenna elements.

36. A reconfigurable antenna array comprising:

an array of antenna subelements;

a plurality of microelectromechanical system (MEMS) switches selectably connecting adjacent antenna subelements;

an optically sensitive element to selectably control each of the MEMS switches;

a matrix of optical power controlling elements to cause selective illumination of the optically sensitive element corresponding to each MEM switch so as to change an electromagnetic configuration of the antenna array; and a high impedance electromagnetically reflective layer, wherein the matrix of optical power controlling elements control optical power to enter a transmissive region of the reflective layer on a first side thereof, and wherein the optically sensitive elements are on a second side of the reflective layer.

37. The reconfigurable antenna array of claim 36 including a bias voltage source for providing a bias voltage to actuate each of the MEMS switches into a first condition.

38. The reconfigurable antenna array of claim 37 wherein electrical resistance of an optically sensitive element of a selected MEM switch is lowered upon illumination to cause the selected MEM switch to actuate into a second condition.

39. The reconfigurable antenna array of claim 37 wherein the bias voltage source is a photovoltaic array illuminated under control of the matrix of optical power controlling elements.

40. The reconfigurable antenna array of claim 39 wherein the photovoltaic array is illuminated to actuate all the MEMS switches into a first condition.

41. The reconfigurable antenna array of claim 37 wherein the bias voltage source actuates all the MEMS switches into a first condition in an absence of illumination.

42. The reconfigurable antenna array of claim 36, wherein the antenna array further comprises:

a substrate layer on which the plurality of MEMS switches and the array of subelements are disposed; and an insulating material layer disposed between the antenna subelements and the reflective layer.

43. The reconfigurable antenna array of claim 42 wherein the optically transmissive regions of the reflective layer include apertures through the optical transmission structure.

44. The reconfigurable antenna array of claim 43 wherein at least one of the apertures is electrically conductive and conducts a bias voltage to at least one of the MEM switches.

45. The reconfigurable antenna array of claim 44 wherein the reflective layer comprises a multilayer printed circuit board and the optical apertures are vias through the multilayer printed circuit board.

46. The reconfigurable antenna array of claim 36 wherein the reflective layer is located less than one quarter wavelength of an antenna operating frequency from the array of subelements.

47. The reconfigurable antenna array of claim 36, wherein the array comprises one of a plurality of subarray modules.

48. The reconfigurable antenna array of claim 47, wherein the plurality of subarray modules are configured to provide the primary reflector of a Cassegrain antenna.

49. The reconfigurable antenna array of claim 36, wherein at least one of the antenna subelements is an antenna element selected from the group consisting of dipole antenna elements, patch antenna elements, and slot antenna elements.

* * * * *